United States Patent [19]

McDermott et al.

[11] Patent Number: 4,575,976

[45] Date of Patent: Mar. 18, 1986

[54] EXTENSION AND RETRACTION SYSTEM FOR BOOM APPARATUS

[75] Inventors: Charles McDermott, Lakewood; Magbool A. Zafar, Fontana, both of Calif.

[73] Assignee: Machine Products Corporation, Kansas City, Kans.

[21] Appl. No.: 507,349

[22] Filed: Jun. 24, 1983

[51] Int. Cl.[4] ..... E04H 12/34

[52] U.S. Cl. ..... 52/118; 52/119; 91/167 R; 92/51; 92/137; 212/269; 212/268

[58] Field of Search ..... 52/118, 119, 111, 121; 92/51, 137; 91/167; 212/269, 268

[56] References Cited

U.S. PATENT DOCUMENTS

| | | | |
|---|---|---|---|
| Re. 30,905 | 4/1982 | Lester | 52/118 |
| 2,674,500 | 4/1954 | Hukari | 304/29 |
| 3,259,251 | 7/1966 | Stauffer | 212/268 |
| 3,337,071 | 8/1967 | Clark | 214/146.5 |
| 3,419,157 | 12/1968 | Brady | 212/268 |
| 3,477,229 | 11/1969 | Katko | 91/167 R |
| 3,543,494 | 12/1970 | Bartram | 56/328 |
| 3,572,467 | 3/1971 | Hall | 182/67 |
| 3,715,039 | 2/1973 | Kollmann | 212/268 |
| 3,809,249 | 5/1974 | Grove | 212/268 |
| 3,840,128 | 10/1974 | Swoboda | 214/1 BD |
| 3,845,596 | 11/1974 | Veenstra | 52/118 |
| 3,878,957 | 4/1975 | Rempel | 214/508 |
| 3,953,960 | 5/1976 | Craven | 56/328 R |
| 4,004,695 | 1/1977 | Hockensmith | 52/118 |
| 4,169,338 | 10/1979 | Eik | 52/118 |
| 4,185,426 | 1/1980 | Prescott | 52/115 |
| 4,217,987 | 8/1980 | Gatta | 52/118 |
| 4,226,300 | 10/1980 | Rallis | 182/2 |
| 4,245,441 | 1/1981 | Smith, Jr. | 52/111 |
| 4,388,033 | 1/1983 | Pipes | 52/118 |

*Primary Examiner*—Henry E. Raduazo

*Attorney, Agent, or Firm*—Fulwider, Patton, Rieber, Lee & Utecht

[57] ABSTRACT

An extension and retraction system for a multiple section, telescoping boom apparatus of the type utilized for raising and lowering a work platform or basket. The innermost longitudinally movable section is carried by a longitudinally inextensible or base section, and is extensible and retractable relative to the base section by a dual cylinder assembly. Extension chains trained about sprockets carried by certain of the sections automatically extend the other extensible sections upon extension by the cylinder assembly of the innermost longitudinally movable section. Automatic and positive retraction of such sections is accomplished by retraction chains operating in response to retraction of the innermost section. The cylinders of the dual cylinder assembly are pivotally coupled at a pivot mount longitudinally slidable along a guideway carried by the base section to thereby accommodate deflections of the boom sections located between the opposite extremities of the dual cylinder assembly. A feature of the apparatus is use of slide pads disposed between the boom sections to transmit loads, the pads being configured to accomplish this with minimum wear.

11 Claims, 9 Drawing Figures

EXTENSION AND RETRACTION SYSTEM FOR BOOM APPARATUS

BACKGROUND OF THE INVENTION

1. Field of the Invention

The present invention relates to a telescoping boom apparatus and particularly to an extension and retraction system for such apparatus.

2. Description of the Prior Art

Multiple section, telescoping boom apparatus is well known in the prior art for extension and retraction of a working platform or basket which is suspended from the outermost section. A typical application for such an apparatus is the harvesting of fruit from tall trees such as date trees. The boom apparatus is normally attached to a mobile platform, and pneumatic or hydraulic cylinders are provided to pivot the boom sections about a horizontal axis for raising and lowering the picker's basket.

The height of such date palms makes use of a four section boom apparatus preferable, one section being an inextensible base section which is pivoted to the mobile platform. The other boom sections are longitudinally extensible by operation of a pneumatic or hydraulic cylinder in conjunction with a cable and sheave arrangement.

Some systems of the prior art employ a single cylinder connected between the base section and the outermost section, but such an arrangement is generally impractical where the length of the extended sections is great. Other prior art systems employ a plurality of cylinders, one for each section, but these are unduly complex and involve high production and maintenance expense. A system which is preferred employs a single cylinder to extend one of the sections, with a cable and sheave arrangement being arranged to automatically extend the other sections in response to extension of the first section. However, this arrangement is not entirely satisfactory. For long boom extensions the piston rod of the cylinder is necessarily of relatively large diameter, very expensive, and subject to deflection at maximum boom extensions. Further, although the cable and sheave arrangement is generally satisfactory to extend the boom sections, there is no means for positively retracting the sections. Instead, the practice has been to pivot the boom sections upwardly at an angle such that their weight telescopably retracts them. It is desirable to have some means for retracting the boom sections at lesser angles of elevation.

SUMMARY OF THE INVENTION

According to the present invention, an extension and retraction system is provided for a telescoping four section boom apparatus to both positively extend and retract the sections regardless of the elevation angle of the boom sections. An inextensible base section is adapted to be mounted to a mobile platform for pivotal movement about a horizontal axis. Three longitudinally movable sections are fitted to the base section, the innermost of these being extensible and retractable by a double acting, fluid actuated double cylinder assembly. The inner cylinder is attached to the base section, the other cylinder is pivotally mounted to the innermost extensible section, and the adjacent extremities of the cylinders are pivotally attached to a pivot mount which is longitudinally slidable along a guideway fixed to the base section. Thus, extension of the piston rod of the first cylinder moves or extends the second cylinder, and the piston rod of the second cylinder extends the innermost section. The pivot mount thereby accommodates load deflection of the boom sections without destructive bending of the piston rods of the cylinders. Sprocket and chain assemblies are provided to automatically and positively extend the other extensible sections upon cylinder actuated extension of the innermost section.

Positive retraction of the extensible and retractable sections is provided by a pair of retraction chains trained about sprockets mounted to the innermost longitudinally movable or retractable section and the next adjacent retractable section, respectively. One end of the first chain is attached to the base section and the other end is attached adjacent the innermost retractable section. The opposite ends of the second chain are attached to the outermost section and to the innermost retractable section. Thus, inward longitudinal movement of the innermost section pulls the next section inwardly, and inward movement of that section pulls in the outermost section.

Load bearing disks are disposed between adjacent surfaces of the sections to transmit bending loads from one section to the other. It is a particular feature of the disks that they are configured to transmit such loads substantially uniformly throughout a range of boom section deflections whereby premature wearing of the disks is prevented.

Other objects and features of the invention will become apparent from consideration of the following description taken in connection with the accompanying drawings.

DESCRIPTION OF THE PREFERRED EMBODIMENTS

Figure 1:
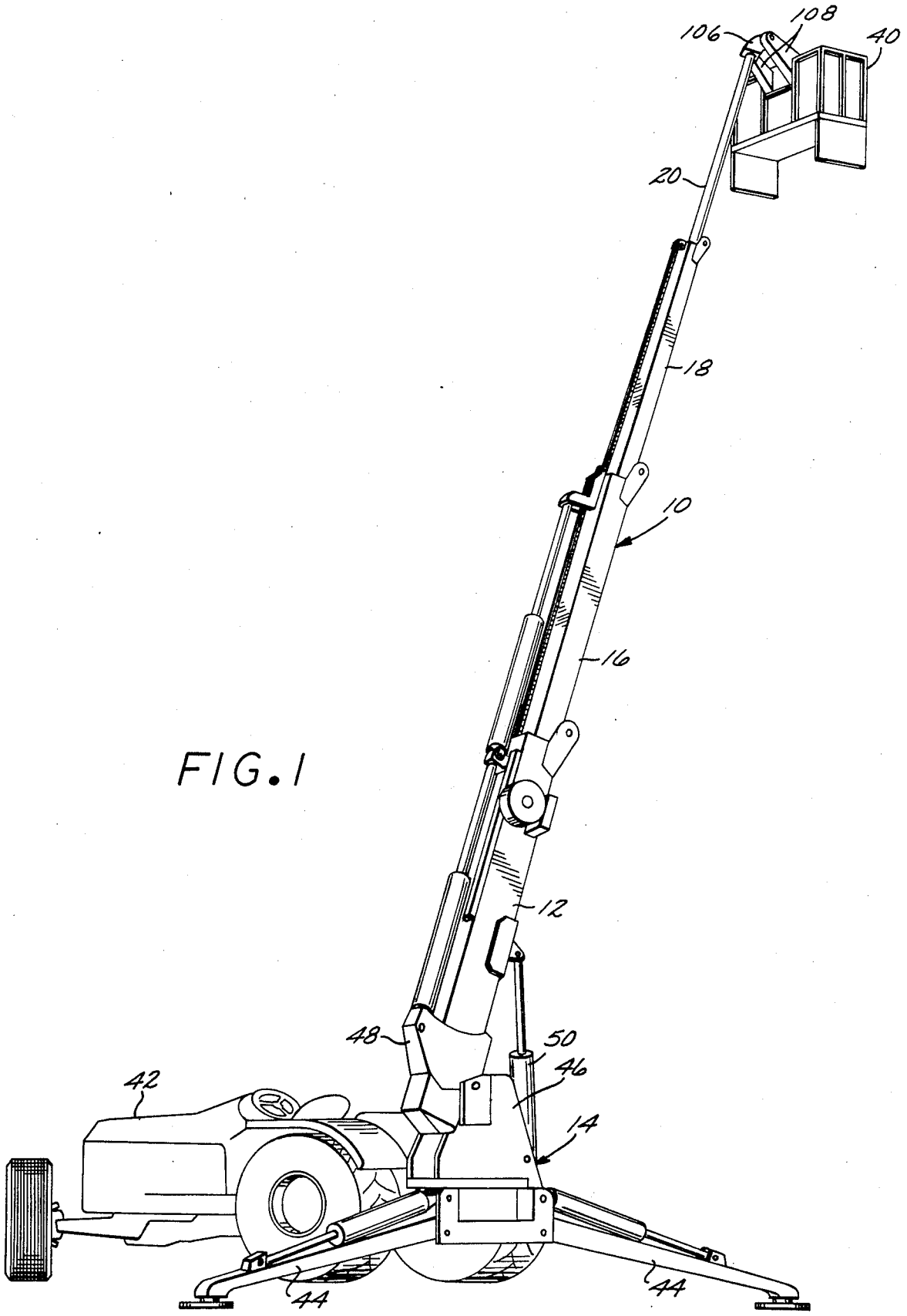
FIG. 1 is a perspective view of the present boom apparatus mounted to a mobile platform.
Figures 2, 3, 4:
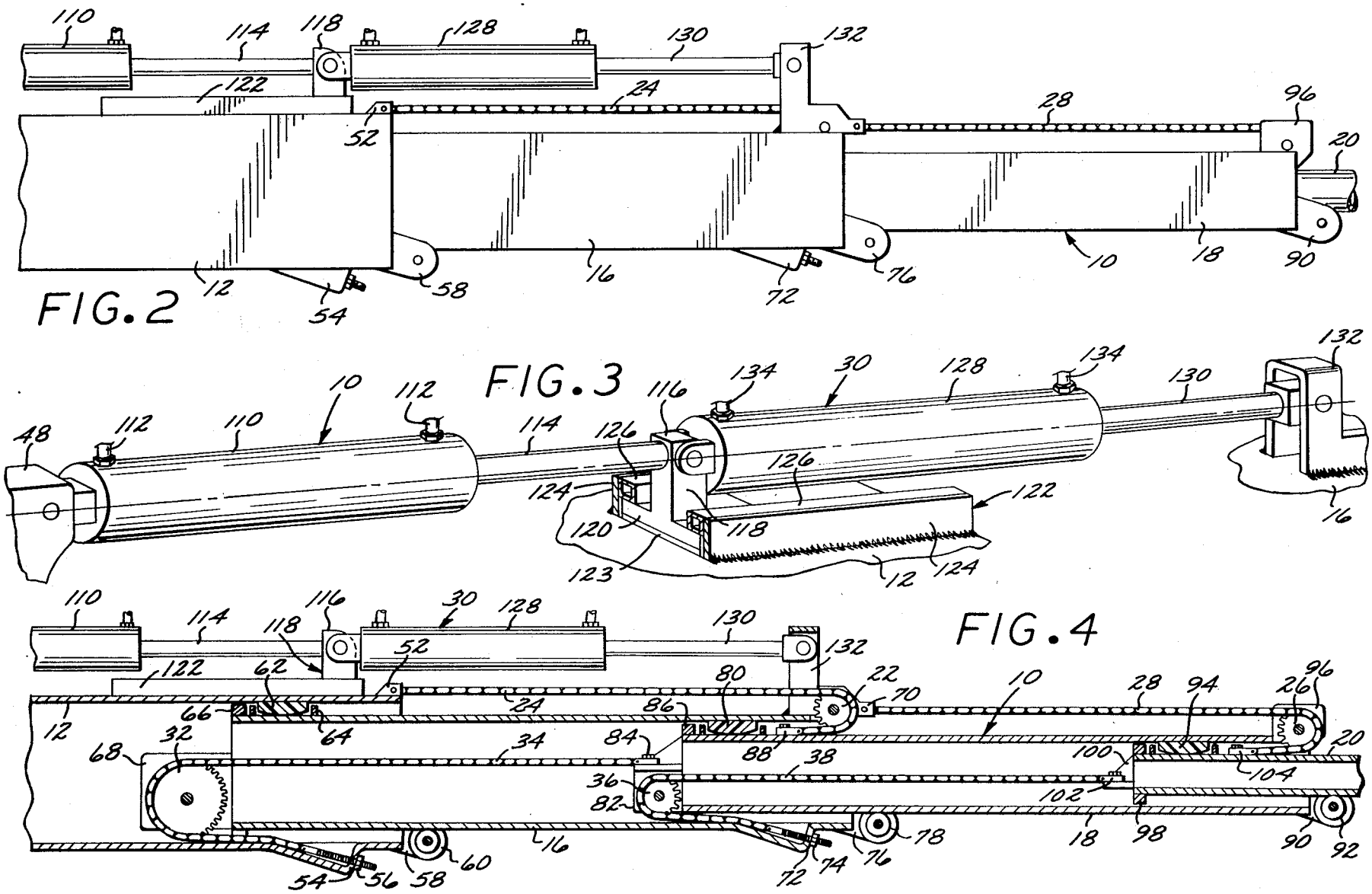
FIG. 2 is a side elevational view of a portion of the assembled boom sections in their extended positions.
FIG. 3 is a partial perspective view of the double cylinder and its mounting to the boom sections.
FIG. 4 is a partial longitudinal crosssectional view of the boom sections of FIG. 2 in their extended positions.
Figure 5:
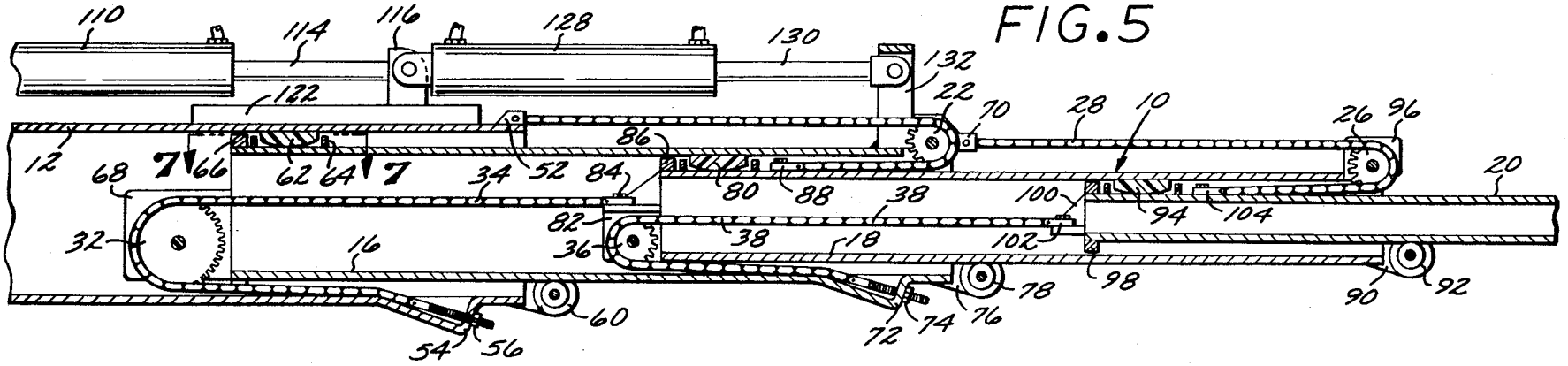
FIG. 5 is a view similar to FIG. 4, but illustrating the boom sections partially retracted.
Figure 6:
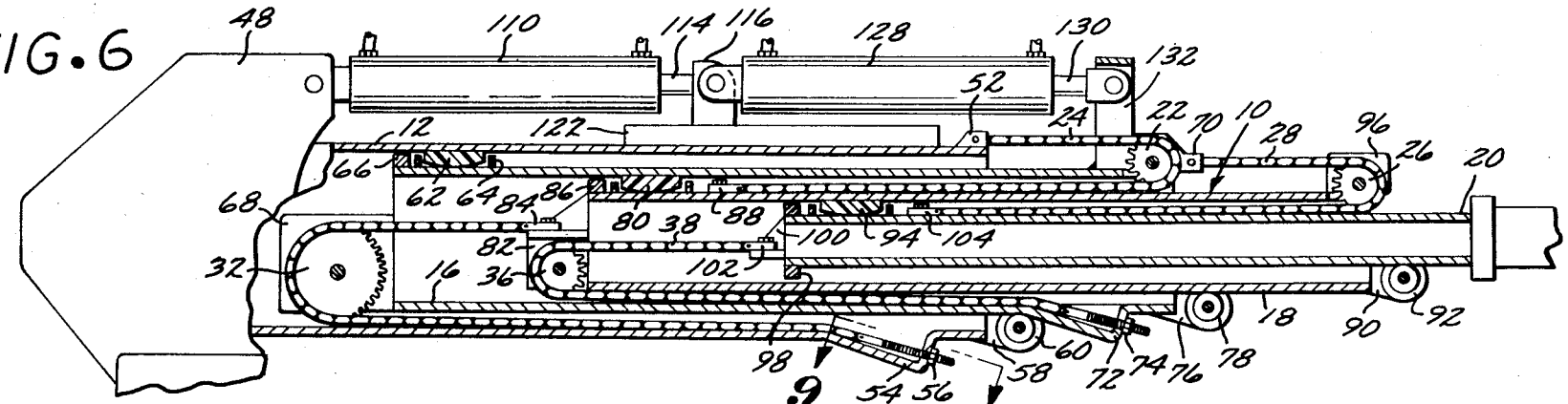
FIG. 6 is a view similar to FIG. 4, but illustrating the boom sections fully retracted.
Figure 9:
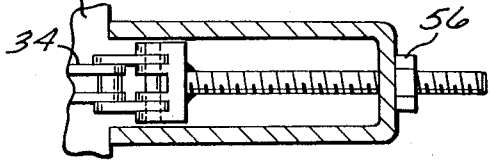
FIG. 9 is an enlarged view taken along the line 9—9 of FIG. 6.

Referring now to the drawings, and particularly to FIGS. 1, 2 and 4, there is illustrated a boom apparatus 10 comprising, generally, a base section 12 adapted for mounting to a mobile platform 14 for pivotal movement about a horizontal axis; an inner section 16 carried by the base section 12; an intermediate section 18 carried by the inner section 16; an outer section 20 carried by the intermediate section 18; an inner extension sprocket 22 carried by the inner section 16; a base-to-intermediate extension chain 24 trained about the sprocket 22 and attached at its opposite ends to the base and intermediate sections 12 and 18, respectively; an intermediate extension sprocket 26 carried by the intermediate section 18; an inner-to-outer extension chain 28 trained about the sprocket 26 and attached at its opposite ends to the inner and outer sections 16 and 20, respectively; and fluid actuated means 30 for extending the inner section 16 whereby the intermediate and outer sections 18 and 20 are automatically extended.

The boom apparatus 10 further includes an inner retraction sprocket 32 carried by the inner section 16; a base-to-intermediate retraction chain 34 trained about the sprocket 32 and attached at its opposite ends to the base and intermediate sections 12 and 18; an intermediate retraction sprocket 36 carried by the intermediate section 18; and an inner-to-outer retraction chain 38 trained about the sprocket 36 and attached at its opposite ends to the inner and outer sections 16 and 20. As will be seen, the fluid actuated means 30 is also actuable for retracting the inner section 16, which automatically retracts the intermediate and outer sections 18 and 20 by reason of the action of the chains 34 and 38.

The boom sections 12, 16, 18 and 20 are hollow, elongated, and generally rectangular in transverse cross-section. However, the present invention is not limited to a particular boom section configuration, being also applicable to various types of telescoping tubular struts, slidable ladders and aerial lift apparatus. Further, although the invention is described in conjunction with a fruit harvesting platform or basket 40 which is carried at the end of the section 20, the invention is also useful in elevating equipment such as water nozzles or the like, and also personnel who must work in high places. In addition, the boom apparatus 10 need not be used with a mobile platform 14, but can be used in a fixed installation also, if desired, since the invention is primarily concerned with extension and retraction of the boom sections.

The terms "inner" and "outer", when used with respect to the boom sections, are intended to denote the boom sections nearest to or farthest from the platform 14, respectively.

Details respecting suitable pneumatic or hydraulic systems for actuating the fluid actuated means 30 are omitted for brevity since they are well known to those skilled in the art. For similar reasons, details respecting suitable controls for raising and lowering the boom apparatus 10 relative to the platform 14 are also omitted.

The mobile platform 14 is typically a wheeled vehicle 42 stabilized by outrigger legs 44, and including a fixed base portion 46 supported by the structure of the vehicle 42 for rotation about a vertical axis.

A movable base portion 48 is mounted to the fixed base portion 46 for pivotal movement about a horizontal axis, the base portion 46 including the base section 12 which forms part of the boom apparatus 10. The boom apparatus 10 is raised and lowered by a cylinder 50 connected between the fixed base portion 46 and the base section 12.

Although not illustrated, the harvesting basket 40 typically includes suitable controls known in the prior art for operation by the workman or picker to rotate, raise or lower and telescope the boom sections of the apparatus 10.

Referring now to FIGS. 2–9, the open outer end of base section 12 telescopably receives the inner end of the inner section 16. The upper wall of the base section 12 adjacent its open end mounts a chain anchorage 52 to which the end of the chain 24 is attached.

The lower wall of the base section 12 is outwardly offset to define a transverse section 54 through which a threaded stud extends. The stud is attached to the end of the chain 34 and carries a nut 56 for adjusting chain tension.

Figure 8:
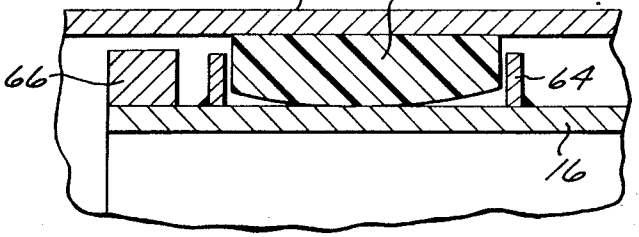
FIG. 8 is an enlarged view taken along the line 8—8 of FIG. 7.
Figure 7:
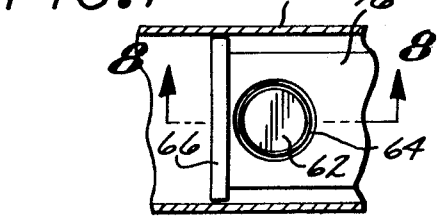
FIG. 7 is a partial view taken along the line 7—7 of FIG. 5.

The lower wall of the base section 12 also mounts a bracket 58 which rotatably mounts a support roller 60. The roller 60 rotatably engages the lower wall of the adjacent inner section 16 to support the section 16 under load. Such loads are also transmitted to the upper wall of the base section 12 by a circular slide pad 62 located longitudinally inwardly of the support roller 60. As best seen in FIGS. 7 and 8, the pad 62 has a flat upper face in slidable engagement with the adjacent inner surface of the upper wall of the base section 12. In contrast, the lower surface of the pad 62 is convex.

Under no load conditions the central area of the pad 62 engages the adjacent outer surface of the upper wall of the inner section 16. However, upon downward deflection of the outer end of the inner section 16, a more inwardly located portion of the convex face of the pad 62 is engaged, the area of engagement being essentially the same for both deflected and undeflected conditions of the section 16. The constant but changing area of engagement provides a relatively uniform constraint against axial extension and retraction of the section 16 at various load conditions. In addition, the pad 62 is free to rotate about a vertical axis, further constantly changing the area of slidable engagement. The changing location of the pad wear surface greatly prolongs its service life.

The pad 62 is held in position by a circular retainer 64 which surrounds it and which is welded to the section 16. The pad 62 is free, however, to move within the area bounded by the retainer 64.

The pad 62 is made of any suitable low friction, long wearing plastic material, as will be apparent to those skilled in the art.

The inner end of the base section 12 includes a circular guide collar 66 adapted to ride against the inner surfaces of the adjacent base section 12 for centering and aligning the longitudinal axis of the section 16 with the longitudinal axis of the section 12.

The inner end of the inner section 16 mounts a projecting bracket 68 to rotatably support the sprocket 32. The opposite or outer end of the section 16 also mounts a bracket (not shown) to rotatably support the sprocket 22. The unillustrated bracket also mounts a chain anchorage 70 to which is attached the end of extension chain 28.

Like the lower wall of the base section 12, the lower wall of the inner section 16 includes a transverse section 72 through which is disposed a threaded stud. The stud is mounted to one end of the retraction chain 38, and carries a nut 74 for adjusting of the tension of chain 38.

The outer end of section 16 mounts a bracket 76 and support roller 78 identical to the bracket 58 and roller 60 previously described, the roller 78 engaging the outer surface of the lower wall of the intermediate section 18 to support it under load. In addition, a slide pad 80, identical to slide pad 62 in configuration and operation, is located longitudinally inwardly of the roller 78 and bears at its opposite faces against the upper wall of the section 16 and the upper wall of the section 18, respectively.

The construction of the intermediate section 18 is virtually identical to that of the section 16, section 18 being characterized at its inner end by a bracket 82 which rotatably mounts the sprocket 36. The bracket 82 also mounts a chain anchorage 84 to which one end of chain 34 is attached. The inner end of the section 18 also includes a guide collar 86 identical in configuration and operation to the guide collar 66 previously described.

A chain anchorage 88 is attached to the upper wall of the section 18 just axially outwardly of the slide pad 80, and one end of chain 24 is attached to it.

The outer end of section 18 includes a bracket 90 and a support roller 92 identical in operation and function to that of the previously described brackets 58 and 60, the roller 92 serving to bear loads experienced by the outer section 20. In addition, a slide pad 94, identical in configuration and operation to the previously described slide pad 62, is located longitudinally inwardly of the roller 92 for engagement with the confronting services of the intermediate section 18 and the outer section 20. Further, the outer end of the upper wall of the section 18 mounts a bracket 96 which rotatably supports the sprocket 26.

The construction of the inner extremity of the outer section 20 is similar to that of the sections 16 and 18, the inner end including a guide collar 98 to center the section 20 within the section 18, and further including an end bracket 100 which mounts a chain anchorage 102 to which one end of chain 38 is attached. Another chain anchorage 104 is secured to the upper wall of the section 20 longitudinally outwardly of the slide pad 94, and one end of chain 28 is attached to it.

As best seen in FIG. 1, the outer end of the outer section 20 includes an end fitting 106 which is pivotally mounted to a pair of support arms 108 forming a part of the basket 40.

Referring now to FIGS. 3 and 4, the fluid actuating means 30 is characteristically able to accommodate deflection of the boom sections without damage to the roads of the cylinders forming a part of the means 30. More particularly, the means 30 is articulated, comprising a double acting inner hydraulic cylinder 110 provided with usual fluid inlets/outlets and pivotally connected at its inner end to base portion 48.

The piston rod 114 of the cylinder 110 is fixed to the upright portion 116 of a T-shape inner pivot mount 118. The wider base portion 120 of the mount 18 is longitudinally slidable along a longitudinally extending guide way 122. The guide way 122 is defined by a base plate 123 made of any suitable bearing material and retained between a pair of laterally spaced apart walls 124. The upper inner extremities of the walls 124 mount elongated tubular retainers 126 which overlie the base portion 120. Suitable bearing material is also interposed between the walls 124 and the base portion 120, and between the retainers 126 and the base portion 120 to minimize friction.

Actuation of the cylinder 110 extends the piston rod 114 which, in turn, longitudinally moves the pivot mount 118 outwardly along the guide way 122. This also outwardly moves an outer cylinder 128 which is carried by the pivot mount 118 and which forms a part of the means 30. The inner end of the cylinder 128 is pivoted to the mount 118, and its piston rod 130 is pivotally mounted to an outer pivot mount 132 of inverted U-shape. The mount 132 is fixed to the upper wall of the inner section 16.

Actuation of the outer cylinder 128 is preferably from the same pressure source connected to the inner cylinder 110. Actuation is through pressure fittings 134. Consequent extension of the piston rod 130 telescopably extends the inner section 16 out of the base section 12.

With this articulated interconection of the cylinders 110 and 128, it will be apparent that deflections of the sections 16 and 12 under load are accommodated by the pivotal connections of the cylinders to the base portion 48 and the pivot mounts 118 and 132.

Extension of the sections 18 and 20 is automatic, occurring as a result of the extension of the inner section 16. More particularly, as the inner section 16 is moved outwardly by the simultaneous actuation of the cylinders 110 and 128, the inner extension sprocket 22 carried by the inner section 16 acts upon the chain 24 connected to the inner end of the intermediate section 18. The chain 24, acted upon by the sprocket 22, pulls upon the section 18, moving it outwardly of the section 16 from the position of FIG. 6, to the position of FIG. 5, and finally to the fully extended position of FIG. 4.

As the extension of the section 18 proceeds, the sprocket 26 carried by the section 18 acts upon the chain 28 which is attached to the inner end of the outer section 20. This causes the chain 28 to pull upon the section 20 and extend it outwardly from the position of FIG. 6 to the position of FIG. 5, and finally to the fully extended position of FIG. 4. During the extensions of the sections 16, 18 and 20, the downwardly acting loads upon the sections are borne by the rolling support rollers 60, 78 and 92, respectively. These loads are also borne by the sliding slide pads 62, 80 and 94, as previously described. Thus, cylinder extension of the inner section 16 is automatically accompanied by extension of the sections 18 and 20 by virtue of the action of the extension chains 24 and 28.

During the extension of the boom sections, the retraction chains 34 and 38 offer no resistance to such extension. However, the chains 34 and 38 have an important function in automatically retracting the boom sections. More particularly, the double acting cylinders 110 and 128 are actuated in the opposite direction to retract the inner section 16.

Inward movement of the inner section 16 causes the sprocket 32 carried by the section 16 to act upon the retraction chain 34 which is attached to the inner end of the section 18. This pulls in the section 18. Inward movement of the section 18 inwardly moves the sprocket 36 which is mounted to the section 18, and this urges the sprocket 36 against the chain 38 which is attached to the inner end of the outer section 20. The outer section 20 is thereby drawn telescopably within the section 18. The automatic retraction of the sections 28 and 20 as the section 16 is moved inwardly is sequentially shown in FIGS. 4, 5 and 6.

In summary, the present invention not only provides the desired automatic extension of the sections 18 and 20, but also automatic retraction of those sections, and using an articulated actuating cylinder arrangement which makes possible relatively long boom extensions.

Various modifications and changes may be made with regard to the foregoing detailed description without departing from the spirit of the invention.

We claim:

1. In a boom apparatus comprising elongated, telescoping boom sections, certain of said sections being extensible and retractable relative to a base section adapted for mounting to a mobile platform for pivotal movement about a horizontal axis, said certain sections including an inner section carried by said base section; an intermediate section carried by said inner section; an outer section carried by said intermediate section; an inner extension sprocket carried by said inner section; a base-to-intermediate extension chain trained about said inner extension sprocket and attached at its opposite ends to said base and intermediate sections, respectively; an intermediate extension sprocket carried by said intermediate section; and an inner-to-outer extension chain trained about said intermediate extension sprocket and attached at its opposite ends to said inner and outer sections, respectively, an improved extension and retraction system comprising:

an inner retraction sprocket carried by said inner section;

a base-to-intermediate retraction chain trained about said inner retraction sprocket and attached at its opposite ends to said base and intermediate sections, respectively;

an intermediate retraction sprocket carried by said intermediate section;

an inner-to-outer retraction chain trained about said intermediate retraction sprocket and attached at its opposite ends to said inner and outer sections, respectively, said means for extending being further actuable for retracting said inner section whereby said intermediate and outer sections are automatically retracted through the action of said base-to-intermediate and inner to outer retraction chain; and a fluid actuated boom extension cylinder assembly including a longitudinally extending guideway fixed to said base section, an inner mount longitudinally slidably carried by said guideway, an outer mount fixed to said inner section, an inner cylinder connected to said inner mount and actuable to outwardly slide said inner mount along said guideway, an outer cylinder connected to said inner mount and to said outer mount and actuable to extend said inner section for automatically extending said intermediate and outer sections.

2. The improved extension and retraction system of claim 1 wherein said inner retraction sprocket is carried at the inner end of said inner section.

3. The improved extension and retraction system of claim 1 wherein said intermediate retraction sprocket is carried at the inner end of said intermediate section.

4. The improved extension and retraction system of claim 1 wherein said opposite ends of said base-to-intermediate retraction chain are secured, respectively, to the inner ends of said base and intermediate sections.

5. The improved extension and retraction system of claim 1 wherein said opposite ends of said inner-to-outer retraction chain are secured, respectively, to the inner ends of said inner and outer sections.

6. The improved extension and retraction system of claim 1 and including a plurality of support rollers carried by the outer ends of said base, inner and intermediate sections, respectively, and underlying and supporting said inner, intermediate and outer sections, respectively.

7. The improved extension and retraction system of claim 6 and including a plurality of slide pads carried by said inner, intermediate and outer sections and sliably engaged upon said base, inner and intermediate sections, respectively, each of said plurality of slide pads being located, in all positions of extension of said boom sections, longitudinally inwardly of that one of said support rollers carried by that one of said sections by which the slide pad is carried.

8. In a boom apparatus comprising elongated, telescoping boom sections, certain of said sections being extensible and retractable relative to a base section adapted for mounting to a mobile platform for pivotal movement about a horizontal axis, said certain sections including an inner section carried by said base section; an intermediate section carried by said inner section; an outer section carried by said intermediate section; an inner extension sprocket carried by said inner section; a base-to-intermediate extension chain trained about said inner extension sprocket and attached at its opposite ends to said base and intermediate sections, respectively; an intermediate extension sprocket carried by said intermediate section; and an inner-to-outer extension chain trained about said intermediate extension sprocket and attached at its opposite ends to said inner and outer sections, respectively; and means actuable for extending said inner section whereby said intermediate and outer sections are automatically extended, an improved extension and retraction system comprising:

an inner retraction sprocket carried by said inner section;

a base-to-intermediate retraction chain trained about said inner retraction sprocket and attached at its opposite ends to said base and intermediate sections, respectively;

an intermediate retraction sprocket carried by said intermediate section;

an inner-to-outer retraction chain trained about said intermediate retraction sprocket and attached at its opposite ends to said inner and outer sections, respectively, said means for extending being further actuable for retracting said inner section whereby said intermediate and outer sections are automatically retracted through the action of said base-to-intermediate and inner to outer retraction chains; and a plurality of generally circular slide pads carried by said inner, intermediate and outer sections, each having a face slidably engaged upon said base, inner and intermediate sections, respectively, each said face being convex in configuration, said inner, intermediate and outer sections each including a retainer surrounding the associated one of said slide pads in spaced relation whereby each said slide pad is rotatable within its associated said retainer.

9. In a boom apparatus comprising elongated, telescoping boom sections, certain of said sections being extensible and retractable relative to a base section adapted for mounting to a mobile platform for pivotal movement about a horizontal axis, said certain sections including an inner section carried by said base section; an intermediate section carried by said inner section; an outer section carried by said intermediate section; an inner extension sprocket carried by said inner section; a base-to-intermediate extension chain train ed about said inner extension sprocket and attached at its opposite ends to said base and intermediate sections, respectively; an intermediate extension sprocket carried by said intermediate section; and an inner-to-outer extension chain trained about said intermediate extension sprocket and attached at its opposite ends to said inner and outer sections, respectively, whereby, upon extension of said inner section, said intermediate and outer sections are automatically extended, an improved extension and retraction system comprising:

a fluid actuated boom extension cylinder assembly including a longitudinally extending guideway fixed to said base section, an inner pivot mount longitudinally slidably carried by said guideway, an outer pivot mount fixed to said inner section, an inner cylinder pivotally connected to said inner pivot mount and actuable to outwardly slide said inner pivot mount along said guideway, an outer cylinder pivotally connected to said inner pivot mount and to said outer pivot mount and actuable to extend said inner section for automatically extending said intermediate and outer sections, the pivotal connections at said inner and outer pivot mounts enabling load deflection of said base, inner, intermediate and outer sections without destructively bending the piston rods of said inner and outer cylinders.

10. The improved extension and retraction system of claim 9 wherein said guideway is fixed to the outer extremity of said base section.

11. The improved extension and retraction system of claim 10 wherein said outer pivot mount is fixed to the outer extremity of said inner section.

* * * * *

UNITED STATES PATENT AND TRADEMARK OFFICE

CERTIFICATE OF CORRECTION

PATENT NO. : 4,575,976

DATED : March 18, 1986

INVENTOR(S) : Charles McDermott and Magbool A. Zafar

It is certified that error appears in the above-identified patent and that said Letters Patent is hereby corrected as shown below:

Column 5, line 38, delete "roads" and insert --rods--;

Column 5, line 45, delete "18" and insert --118--;

Column 6, line 51, delete "28" and insert --18--; and

Column 10, line 9, delete "10" and insert --9--.

Signed and Sealed this

*Twenty-fourth* Day of *June 1986*

[SEAL]

*Attest:*

DONALD J. QUIGG

*Attesting Officer*

*Commissioner of Patents and Trademarks*